US010006424B1

(12) United States Patent
Di Nunno et al.

(10) Patent No.: US 10,006,424 B1
(45) Date of Patent: Jun. 26, 2018

(54) PUMP ASSEMBLY AND A PROPULSION SYSTEM

(71) Applicant: GM GLOBAL TECHNOLOGY OPERATIONS LLC, Detriot, MI (US)

(72) Inventors: Davide Di Nunno, Turin (IT); Luca Trabucchi, Turin (IT)

(73) Assignee: GM Global Technology Operations LLC, Detroit, MI (US)

( * ) Notice: Subject to any disclaimer, the term of this patent is extended or adjusted under 35 U.S.C. 154(b) by 19 days.

(21) Appl. No.: 15/388,169

(22) Filed: Dec. 22, 2016

(51) Int. Cl.

| | |
|---|---|
| ***F02M 59/02*** | (2006.01) |
| ***F02M 59/10*** | (2006.01) |
| ***F04B 17/05*** | (2006.01) |
| ***F04B 19/22*** | (2006.01) |
| ***F04B 53/16*** | (2006.01) |

(52) U.S. Cl.
CPC ..... *F02M 59/027* (2013.01); *F02M 59/102* (2013.01); *F04B 17/05* (2013.01); *F04B 19/22* (2013.01); *F04B 53/16* (2013.01)

(58) Field of Classification Search
CPC .... F02M 59/027; F02M 59/102; F04B 17/05; F04B 19/22; F04B 53/16
See application file for complete search history.

(56) References Cited

U.S. PATENT DOCUMENTS

2009/0107442 A1* 4/2009 Ma ..... F02M 39/02 123/179.17
2011/0303195 A1* 12/2011 Lucas ..... F02M 59/102 123/495
2013/0084198 A1* 4/2013 Wood ..... F02M 59/102 417/374

OTHER PUBLICATIONS

"Diesel Engine Fuel Systems"; website: https://archive.hnsa.org/doc/fleetsub/diesel/chap5.htm; Historical Naval Ships Association; Version 1.10, Oct. 22, 2004; retrieval date: Nov. 2016; 32 pages.

* cited by examiner

*Primary Examiner* — Joseph Dallo
(74) *Attorney, Agent, or Firm* — Quinn IP Law

(57) ABSTRACT

A pump assembly and a propulsion system that utilizes the pump assembly includes a casing defining an opening. The pump assembly also includes a first member at least partially disposed in the opening. The first member is movable linearly relative to the opening. The pump assembly further includes a biasing member disposed in the opening. The biasing member is movable independently of the first member. The first member is movable in a first direction that applies a load to the biasing member which creates a torque on the biasing member. The pump assembly also includes a second member that separates the first member and the biasing member such that the torque on the biasing member is transferred to the second member without transferring the torque to the first member when the first member applies the load to the biasing member.

18 Claims, 2 Drawing Sheets

PUMP ASSEMBLY AND A PROPULSION SYSTEM

INTRODUCTION

Vehicles can utilize a fuel pump to inject fuel into an engine. The engine combusts the fuel to generate movement of one or more pistons that ultimately propels the vehicle.

SUMMARY

The present disclosure provides a pump assembly including a casing defining an opening. The pump assembly also includes a first member at least partially disposed in the opening. The first member is movable linearly relative to the opening. The pump assembly further includes a biasing member disposed in the opening. The biasing member is movable independently of the first member. The first member is movable in a first direction that applies a load to the biasing member which creates a torque on the biasing member. The pump assembly also includes a second member that separates the first member and the biasing member such that the torque on the biasing member is transferred to the second member without transferring the torque to the first member when the first member applies the load to the biasing member.

The present disclosure also provides a propulsion system including a camshaft and a pump assembly. The camshaft includes a lobe. The pump assembly includes a casing defining an opening along a longitudinal axis. The casing also defines a groove spaced from and substantially parallel to the longitudinal axis. The lobe of the camshaft is rotatable relative to the casing. The pump assembly also includes a first member at least partially disposed in the opening and engaging the lobe such that rotation of the lobe causes linear movement of the first member relative to the opening. The pump assembly further includes a protrusion fixed to the first member and disposed in the groove to guide the first member linearly relative to the longitudinal axis while minimizing rotation of the first member about the longitudinal axis. The pump assembly also includes a biasing member disposed in the opening and movable independently of the first member. The first member is movable linearly in a first direction that applies a load to the biasing member which creates a torque on the biasing member. The pump assembly further includes a second member that separates the first member and the biasing member such that the torque on the biasing member is transferred to the second member without transferring the torque to the first member when the first member applies the load to the biasing member to minimize rotation of the protrusion in the groove.

The detailed description and the drawings or Figures are supportive and descriptive of the disclosure, but the claim scope of the disclosure is defined solely by the claims. While some of the best modes and other embodiments for carrying out the claims have been described in detail, various alternative designs and embodiments exist for practicing the disclosure defined in the appended claims.

DETAILED DESCRIPTION

Those having ordinary skill in the art will recognize that all directional references (e.g., above, below, upward, up, downward, down, top, bottom, left, right, vertical, horizontal, etc.) are used descriptively for the figures to aid the reader's understanding, and do not represent limitations (for example, to the position, orientation, or use, etc.) on the scope of the disclosure, as defined by the appended claims.

Figure 1:
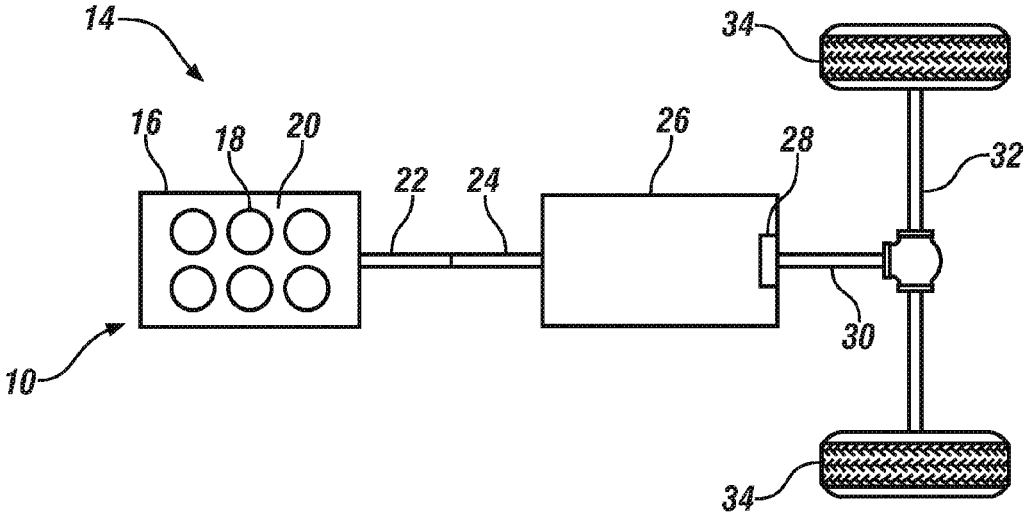
FIG. 1 is a schematic illustration of a propulsion system.
Figure 3:
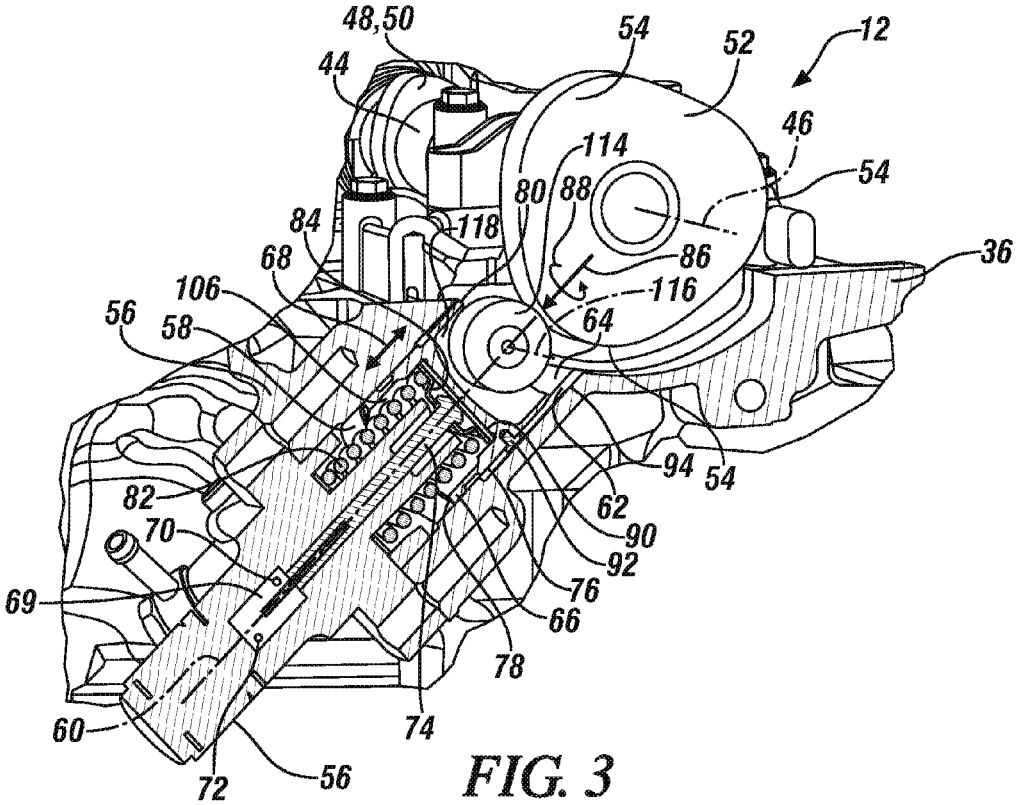
FIG. 3 is a schematic perspective cross-sectional view of a pump assembly.

Referring to the Figures, wherein like numerals indicate like or corresponding parts throughout the several views, a propulsion system 10 is generally shown in FIG. 1 and a pump assembly 12 is generally shown in FIG. 3.

The propulsion system 10 and the pump assembly 12 can be utilized in a vehicle application or a non-vehicle application. For illustrative purposes only, the propulsion system 10 is illustrated with a vehicle 14 in FIG. 1. Non-limiting examples of the vehicles 14 can include cars, trucks, motorcycles, boats, watercrafts, all-terrain vehicles, off-road vehicles, aircrafts, farm equipment or any other suitable movable platform. Non-limiting examples of the non-vehicles can include machines, farm equipment or any other suitable non-vehicle.

The pump assembly 12 can be utilized to move a liquid fluid. Non-limiting examples of the liquid fluid can include fuel, water, mixtures, oil, etc. Therefore, as one non-limiting example, the pump assembly 12 can be a fuel pump.

Figure 2:
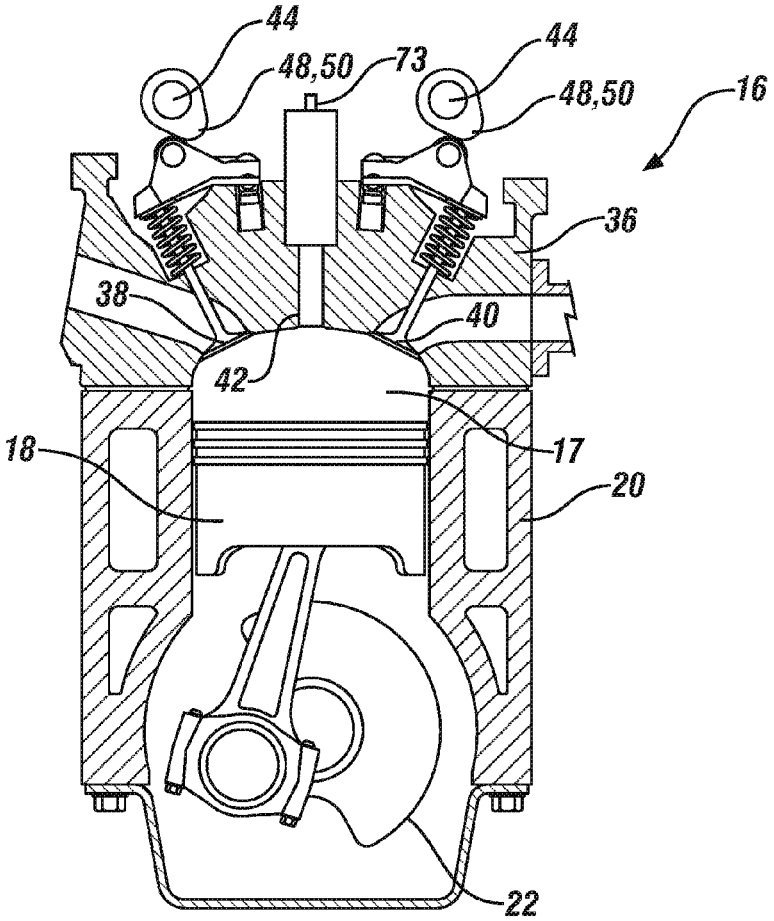
FIG. 2 is a schematic perspective cross-sectional view of an engine.

Referring to FIGS. 1 and 2, the propulsion system 10 can include an engine 16 that operates to propel the vehicle 14. Therefore, the pump assembly 12 can be configured to inject fuel into the engine 16. The engine 16 combusts the fuel in one or more combustion chambers 17 to generate movement of one or more pistons 18 relative to respective combustion chamber(s) 17 that ultimately propels the vehicle 14. Specifically, fuel can be injected into a cylinder 20 of the engine 16, and specifically into the combustion chambers 17, which is combusted to move the piston(s) 18 which rotates an output shaft 22, such as a crankshaft, to create torque. The torque outputted from the engine 16 is transferred to an input member 24 of a transmission 26. Therefore, torque from rotation of the output shaft 22 is transferred to the input member 24 of the transmission 26, which causes the input member 24 to rotate. The transmission 26 can include a final drive 28 and an output member 30 that delivers output torque to one or more drive axles 32 through the final drive 28, and ultimately to a set of wheels 34 to propel the vehicle 14.

One non-limiting example of the engine 16 is an internal combustion engine, which can include a diesel engine and a gasoline engine. It is to be appreciated that the propulsion system 10 can include any other suitable type of propulsion system.

Generally, the pump assembly 12 can operate to move the liquid fluid at any suitable pressure. Therefore, for example, the pump assembly 12 can be designed to inject the liquid fluid into the desired location at the desired pressure. One non-limiting example is that the pump assembly 12 can be a high-pressure fuel pump that can be utilized with the diesel engine. For example, the high-pressure fuel pump can inject fuel at a minimum pressure of about 150 bar to a maximum pressure of about 3000 bar.

As best shown in FIG. 2, the propulsion system 10 can include a cylinder head 36 which is fixed to the cylinder 20. One or more intake valves 38 and exhaust valves 40 are moveable relative to the cylinder head 36. The intake and exhaust valves 38, 40 operate in conjunction with the respective pistons 18. Generally, the intake valves 38 open to allow air into the cylinder 20 and the exhaust valves 40 open to allow exhaust, from combustion, to expel from the cylinder 20. The cylinder head 36 can also include a plurality of injectors 42 which inject the fuel, from the pump assembly 12, into the cylinder 20 adjacent the respective pistons 18.

Continuing with FIG. 2, the propulsion system 10 can include a camshaft 44 which is rotatable about a central axis 46. The camshaft 44 can be supported by the cylinder head 36. The camshaft 44 can also include a plurality of cams 48 spaced from each other along the camshaft 44. Generally, rotation of the camshaft 44 causes the cams 48 to correspondingly rotate which moves the respective intake valves 38 or respective exhaust valves 40. As one non-limiting example, the cams 48 can cooperate with the exhaust valves 40.

Referring to FIGS. 1 and 2, each of the cams 48 can include an eccentric portion 50. Therefore, when the eccentric portion 50 of the cams 48 engages the respective valves 38, 40, the valve correspondingly moves relative to the cylinder head 36.

Referring to FIG. 1, additionally, the camshaft 44 can include a lobe 52 which is rotatable about the central axis 46. The lobe 52 can be spaced from the cams 48 along the camshaft 44. Generally, rotation of the camshaft 44 causes the lobe 52 to correspondingly rotate which moves part of the pump assembly 12 to inject the liquid fluid into the engine 16, which is discussed further below. The lobe 52 attached to the camshaft 44 is one non-limiting example, and it is to be appreciated that the lobe 52 can be attached to a crankshaft, a counterbalance shaft, a dedicated shaft, or any other suitable shaft.

Optionally, the lobe 52 can include one or more eccentric portions 54. In certain embodiments, the lobe 52 includes a plurality of eccentric portions 54. Each of the eccentric portions 54 can be spaced from each other around the lobe 52. The number of eccentric portions 54 being utilized is equal to the number of combustion chambers 17 being utilized. Therefore, in one complete revolution of the camshaft 44, the pump assembly 12 can inject the liquid fluid into each of the combustion chambers 17. Therefore, for example, if the lobe 52 includes three eccentric portions 54, liquid fluid can be injected into three different combustion chambers 17 in one complete revolution.

Referring to FIG. 3, the pump assembly 12 includes a casing 56 defining an opening 58. The casing 56 can be part of the cylinder head 36, and in certain embodiments, at least part of the casing 56 is a separate piece from the cylinder head 36. It is to be appreciated that the entire casing 56 can be one piece with the cylinder head 36 or the entire casing 56 can be a separate part from the cylinder head 36.

Figure 4:
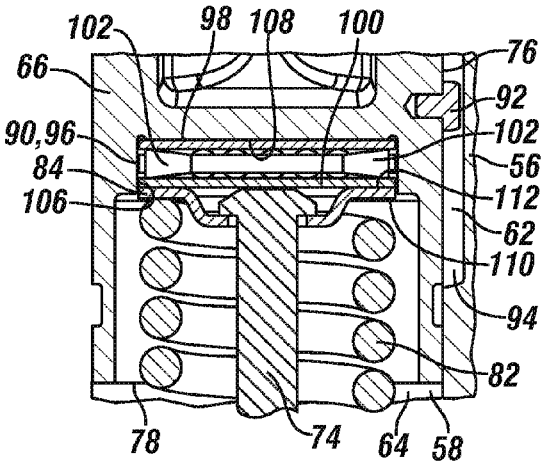
FIG. 4 is a schematic enlarged fragmentary cross-sectional view of a second member of one configuration.
Figure 5:
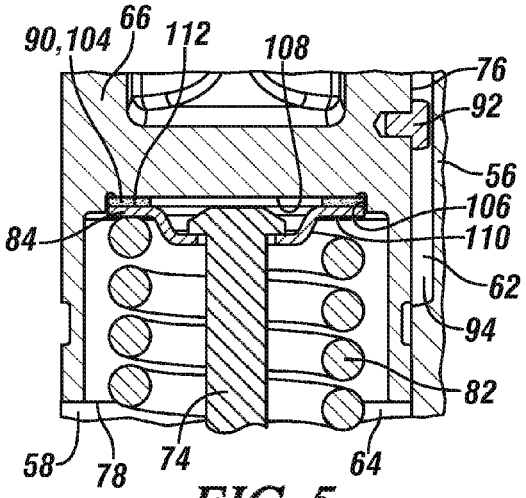
FIG. 5 is a schematic enlarged fragmentary cross-sectional view of the second member of another configuration.

As best shown in FIG. 3, in certain embodiments, the opening 58 is disposed along a longitudinal axis 60. In certain embodiments, the casing 56 can also define a groove 62 spaced from and substantially parallel to the longitudinal axis 60. As best shown in FIGS. 3-5, the groove 62 can be open to the opening 58. Generally, the lobe 52 of the camshaft 44 is rotatable relative to the casing 56. Additionally, the casing 56 can include an inner wall 64 surrounding the opening 58, and the groove 62 can be defined in the inner wall 64.

Turning to FIG. 3, the pump assembly 12 further includes a first member 66 at least partially disposed in the opening 58. In certain embodiments, the first member 66 defines the groove 62 as discussed further below. The first member 66 is movable linearly relative to the opening 58. In other words, the first member 66 is movable along the longitudinal axis 60. Therefore, the first member 66 is movable back and forth in the opening 58 (see arrow 68 in FIG. 3, which generally illustrates the linear directions of movement for the first member 66) between a first position and a second position. The first member 66 can be referred to as a tappet.

The first member 66 engages the lobe 52 such that rotation of the lobe 52 causes linear movement of the first member 66 relative to the opening 58. More specifically, when the respective eccentric portions 54 (of the lobe 52) moves into alignment with the first member 66, the first member 66 moves linearly forward in the opening 58 to the second position. When the respective eccentric portions 54 (of the lobe 52) move out of alignment with the first member 66, the first member 66 moves linearly back in the opening 58 to the first position.

The casing 56 can also define a chamber 69. As the first member 66 moves back and forth, the liquid fluid is either brought into the chamber 69 or removed from the chamber 69. Therefore, referring to FIG. 3, the pump assembly 12 can include an inlet 70 and an outlet 72. In certain embodiments, the casing 56 can define the inlet 70 and the outlet 72; and the inlet 70 and outlet 72 can both be in fluid communication with the chamber 69. The liquid fluid is directed into the chamber 69 by the inlet 70 and directed out of the chamber 69 by the outlet 72. The liquid fluid expelled from the pump assembly 12 is directed into the injectors 42, and then the injectors 42 expel the liquid fluid into the desired combustion chambers 17. One or more conduits 73 can connect the outlet 72 of the pump assembly 12 and the injectors 42 to guide the liquid fluid therebetween. The pump assembly 12 can also include a plunger 74 and any other parts not explicitly discussed herein to move the liquid fluid into and out of the pump assembly 12. Movement of the first member 66 also causes movement of the plunger 74, which pulls and pushes the liquid fluid depending on the direction of movement of the first member 66.

Continuing with FIG. 3, the first member 66 can include an outer periphery 76 facing away from the longitudinal axis 60. More specifically, the outer periphery 76 can face the inner wall 64. The first member 66 can also include a first end 78 and a second end 80 opposing the first end 78 axially along the longitudinal axis 60. The outer periphery 76 can be adjacent to the first and second ends 78, 80. Specifically, the outer periphery 76 faces outwardly in a different direction from the first and second ends 78, 80. The outer periphery 76 will be discussed further below.

Continuing with FIG. 3, the pump assembly 12 also includes a biasing member 82 disposed in the opening 58. The biasing member 82 can bias the first member 66 back to the first position. Generally, the biasing member 82 and the first member 66 are separate parts. The biasing member 82 is movable independently of the first member 66. Specifically, the biasing member 82 can be movable linearly along the longitudinal axis 60, and the biasing member 82 can be rotatable about the longitudinal axis 60.

Turning to FIGS. 3-5, optionally, the pump assembly 12 can include a seat 84 that receives one of the ends of the biasing member 82. As such, the seat 84 can be disposed between the biasing member 82 and the first member 66. The seat 84 can be any suitable configuration.

Generally, when the first member 66 moves linearly back and forth, the biasing member 82 also moves linearly back and forth. Specifically, the biasing member 82 compresses and decompresses during linear movement. The biasing member 82 can be configured to return the first member 66 back to the first position, and the lobe 52 can be configured to move the first member 66 forward to the second position. As such, when the respective eccentric portions 54 of the lobe 52 do not align with the first member 66, the biasing member 82 biases the first member 66 back to the first position. For example, when the first member 66 moves forward into the opening 58 to the second position, the biasing member 82 further compresses; and when the first member 66 is to return to the first position, the biasing member 82 returns the first member 66 to the first position by at least partially decompressing.

The first member 66 is movable in a first direction that applies a load 86 (see arrow 86 in FIG. 3) to the biasing member 82 which creates a torque 88 (see arrow 88 in FIG. 3) on the biasing member 82. In other words, when the first member 66 moves from the first position to the second position, the first member 66 applies the load 86. Furthermore, the biasing member 82 applies a load to the first member 66 to move the first member 66 in a second direction. Generally, the second direction is opposite to the first direction. Therefore, to return the first member 66 to the first position from the second position, the biasing member 82 applies the load to the first member 66.

Referring to FIG. 3, the pump assembly 12 further includes a second member 90 that separates the first member 66 and the biasing member 82 such that the torque 88 on the biasing member 82 is transferred to the second member 90 without transferring the torque 88 to the first member 66 when the first member 66 applies the load 86 to the biasing member 82. Simply stated, the second member 90 is configured to absorb the torque 88 to prevent the torque 88 from being transferred to the first member 66. The second member 90 is shown schematically in FIG. 3 because the second member 90 can have different configurations as discussed further below. As such, FIG. 3 indicates the general location of the second member 90.

Referring to FIGS. 3-5, generally, one of the casing 56 and the first member 66 define the groove 62. Said differently, the groove 62 is defined in the casing 56 or the first member 66. The pump assembly 12 can further include a protrusion 92 fixed to one of the casing 56 and the first member 66. Said differently, the protrusion 92 is fixed to the casing 56 or the first member 66. The protrusion 92 is disposed in the groove 62 to guide the first member 66 linearly while minimizing rotation of the first member 66. Therefore, in certain embodiments, the casing 56 defines the groove 62 and the protrusion 92 is fixed to the first member 66. In other embodiments, the protrusion 92 is fixed to the casing 56 and the first member 66 defines the groove 62. As such, if the casing 56 defines the groove 62, then the protrusion 92 is fixed to the first member 66; and if the protrusion 92 is fixed to the casing 56, then the first member 66 defines the groove 62.

Generally, if the casing 56 defines the groove 62, the protrusion 92 projects from the outer periphery 76 and the groove 62 is open to the opening 58. As such, the protrusion 92 projects outwardly toward the inner wall 64. The protrusion 92 can be disposed in the groove 62 to guide the first member 66 linearly along the longitudinal axis 60 while minimizing rotation of the first member 66 about the longitudinal axis 60. In other words, the protrusion 92 is disposed in the groove 62 to guide the first member 66 linearly relative to the longitudinal axis 60 while minimizing rotation of the first member 66 about the longitudinal axis 60.

Generally, the torque 88 on the biasing member 82 is transferred to the second member 90 without transferring the torque 88 to the first member 66 when the first member 66 applies the load 86 to the biasing member 82 to minimize rotation of the protrusion 92 in the groove 62. As such, minimizing rotation of the protrusion 92, prevents the protrusion 92 from engaging the inner wall 64 to avoid wear of the inner wall 64 along the groove 62.

As best shown in FIG. 3, in certain embodiments, the inner wall 64 can include a wall portion 94 surrounding the groove 62. Therefore, the torque 88 on the biasing member 82 is transferred to the second member 90 without transferring the torque 88 to the first member 66 when the first member 66 applies the load 86 to the biasing member 82 in order to minimize rotation of the protrusion 92 in the groove 62 and avoid applying a predetermined amount of force to the wall portion 94. As such, minimizing rotation of the protrusion 92, minimizes the protrusion 92 from engaging the wall portion 94 to avoid causing wear of the inner wall 64 along the groove 62.

The second member 90 can be in different configurations, some of which are discussed below. Non-limiting examples of the different configurations are illustrated in FIGS. 4 and 5. The below discussion of the second member 90 presents non-limiting examples, and it is to be appreciated that the second member 90 can be other configurations.

Referring to FIG. 4, the second member 90 can be a bearing 96. The bearing 96 can be any suitable configuration, and one non-limiting example is that the bearing 96 is a thrust bearing.

Continuing with FIG. 4, the bearing 96 can include a first race 98 fixed to the first member 66 and a second race 100 abutting the seat 84. The plunger 74 can also abut the second race 100. The bearing 96 can include a plurality of rollers 102 disposed between the races 98, 100 which allow rotational movement of one of the races 98, 100 relative to the other one of the races 98, 100 when the torque 88 is applied to the biasing member 82. The rollers 102 can be any suitable configuration, and non-limiting examples can include spherical balls, tapered rollers with a circular cross-section that is continuously increasing or decreasing, elongated rollers with a circular cross-section continuously the same, etc.

Referring to FIG. 5, the second member 90 is a coating 104. The thickness of the coating 104 is exaggerated in FIG. 5 for illustrative purposes only. It is to be appreciated that the coating 104 can be any suitable thickness and can be applied to one or more surfaces. In one configuration, the coating 104 is disposed on the seat 84. In another configuration, the coating 104 is disposed on the first member 66. In yet another configuration, the coating 104 is disposed on both the seat 84 and the first member 66.

Generally, the coating 104 can include a low friction material, which minimizes the amount of friction between surfaces. As one non-limiting example, the low friction material can include a carbon material, which can include a diamond-like carbon (DLC) coating. Therefore, in certain embodiments, the coating 104 is a DLC coating.

As best shown in FIGS. 4 and 5, the first member 66 can also define a recess 106 facing the biasing member 82. More specifically, the first end 78 of the first member 66 can define the recess 106 facing the biasing member 82. The recess 106 can extend into the first member 66 to a wall 108, and depending on the configuration of the second member 90, one side of the bearing 96 or one side of the coating 104 can abut the wall 108. Generally, in certain embodiments, the second member 90 is at least partially disposed in the recess 106. Therefore, for example, the coating 104 or the bearing 96 can be at least partially disposed in the recess 106.

Continuing with FIGS. 4 and 5, the seat 84 can include a first side 110 facing the biasing member 82 and a second side 112 facing the recess 106. Therefore, the biasing member 82 can engage the first side 110 of the seat 84. For the embodiment of FIG. 4, the second race 100 of the bearing 96 can engage the second side 112 of the seat 84. The second race 100 can rotate relative to the first race 98 when the torque 88 is applied to the biasing member 82, which minimizes the torque 88 being transferred to the first race 98 and the first member 66. For the embodiment of FIG. 5, the coating 104 can be disposed on the second side 112 of the seat 84. It is to be appreciated that the coating 104 can also be disposed along one or more edges of the seat 84 or any other suitable location. The coating 104 minimizes the amount of friction between the seat 84 and the first member 66, which minimizes the torque 88 being transferred to the first member 66.

In certain embodiments, the second member 90 can include both the coating 104 and the bearing 96. In this embodiment, the coating 104 abuts one of the races 98, 100 of the bearing 96 and one side of the seat 84. For example, in this embodiment, the coating 104 can be disposed on the second side 112 of the seat 84 and the coating 104 can abut the second race 100. As another example, in this embodiment, the coating 104 can be disposed on the side of the second race 100 that faces the seat 84 and the coating 104 can abut the second side 112 of the seat 84. Again, the coating 104 can be applied to one or more surfaces.

Referring back to FIG. 3, the pump assembly 12 can further include a third member 114 supported by the first member 66, and the third member 114 engages the lobe 52. The third member 114 is movable linearly with the first member 66. Additionally, the third member 114 is rotatable independently of the first member 66. As shown in FIG. 3, the third member 114 can rotate about a pivot axis 116, and the third member 114 is rotatable in response to engagement with the lobe 52 due to the lobe 52 rotating with the camshaft 44. Generally, the pivot axis 116 can be transverse to the longitudinal axis 60. In certain embodiments, the pivot axis 116 is perpendicular to the longitudinal axis 60. Furthermore, in certain embodiments, the pivot axis 116 is substantially parallel to the central axis 46.

Generally, the third member 114 is supported by the second end 80 of the first member 66. When the respective eccentric portions 54 (of the lobe 52) rotate into alignment with the third member 114, the first member 66 and correspondingly the third member 114, move linearly relative to the opening 58. In certain embodiments, the second end 80 of the first member 66 can define a second recess 118 facing the lobe 52, and the third member 114 can be at least partially disposed in the second recess 118. The third member 114 can be referred to as a roller 102.

While the best modes and other embodiments for carrying out the disclosure have been described in detail, those familiar with the art to which this disclosure relates will recognize various alternative designs and embodiments for practicing the disclosure within the scope of the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

What is claimed is:

1. A pump assembly comprising:

a casing defining an opening;

a first member at least partially disposed in the opening and movable linearly relative to the opening;

a biasing member disposed in the opening and movable independently of the first member, and wherein the first member is movable in a first direction that applies a load to the biasing member which creates a torque on the biasing member; and a second member that separates the first member and the biasing member such that the torque on the biasing member is transferred to the second member without transferring the torque to the first member when the first member applies the load to the biasing member.

2. The assembly as set forth in claim 1 wherein one of the casing and the first member define a groove, and further including a protrusion fixed to one of the casing and the first member, and wherein the protrusion is disposed in the groove to guide the first member linearly while minimizing rotation of the first member.

3. The assembly as set forth in claim 2 wherein the opening is disposed along a longitudinal axis and the casing defines the groove spaced from and substantially parallel to the longitudinal axis, and the protrusion is fixed to the first member, and wherein the protrusion is disposed in the groove to guide the first member linearly along the longitudinal axis while minimizing rotation of the first member about the longitudinal axis.

4. The assembly as set forth in claim 3 wherein:

the casing includes an inner wall surrounding the opening, with the groove defined in the inner wall; and the first member includes an outer periphery facing the inner wall and the protrusion projects from the outer periphery.

5. The assembly as set forth in claim 4 wherein the inner wall includes a wall portion surrounding the groove, and the torque on the biasing member is transferred to the second member without transferring the torque to the first member when the first member applies the load to the biasing member in order to minimize rotation of the protrusion in the groove and avoid applying a predetermined amount of force to the wall portion.

6. The assembly as set forth in claim 1 further including a seat disposed between the biasing member and the first member, and wherein the second member is a coating disposed on the seat.

7. The assembly as set forth in claim 6 wherein the first member defines a recess facing the biasing member, and wherein the seat includes a first side facing the biasing member and a second side facing the recess, and wherein the coating is disposed on the second side of the seat.

8. The assembly as set forth in claim 7 wherein the coating is a diamond-like carbon coating.

9. The assembly as set forth in claim 1 wherein:

the opening is disposed along a longitudinal axis;

the first member includes an outer periphery facing away from the longitudinal axis;

the first member includes a first end and a second end opposing the first end axially along the longitudinal axis, with the outer periphery adjacent to the first and second ends; and the first end of the first member defines a recess facing the biasing member, and the second member is at least partially disposed in the recess.

10. The assembly as set forth in claim 9 further including a seat disposed between the biasing member and the first member, and wherein the second member is a bearing.

11. The assembly as set forth in claim 10 wherein the bearing includes a first race fixed to the first member and a second race abutting the seat, and wherein the bearing includes a plurality of rollers disposed between the races which allow rotational movement of one of the races relative to the other one of the races when the torque is applied to the biasing member.

12. The assembly as set forth in claim 1 further including a third member supported by the first member and movable linearly with the first member, and wherein the third member is rotatable independently of the first member.

13. The assembly as set forth in claim 12 wherein:

the opening is disposed along a longitudinal axis;

the first member includes an outer periphery facing away from the longitudinal axis;

the first member includes a first end and a second end opposing the first end axially along the longitudinal axis, with the outer periphery adjacent to the first and second ends;

the first end of the first member defines a recess facing the biasing member, and the second member is at least partially disposed in the recess; and the third member is supported by the second end.

14. The assembly as set forth in claim 1 wherein the second member is a bearing.

15. The assembly as set forth in claim 14 wherein the bearing is a thrust bearing.

16. The assembly as set forth in claim 1 wherein the second member is a coating.

17. The assembly as set forth in claim 16 wherein the coating is a diamond-like carbon coating.

18. A propulsion system comprising:

a camshaft including a lobe;

a pump assembly comprising:

a casing defining an opening along a longitudinal axis, and defining a groove spaced from and substantially parallel to the longitudinal axis;

wherein the lobe of the camshaft is rotatable relative to the casing;

a first member at least partially disposed in the opening and engaging the lobe such that rotation of the lobe causes linear movement of the first member relative to the opening;

a protrusion fixed to the first member and disposed in the groove to guide the first member linearly relative to the longitudinal axis while minimizing rotation of the first member about the longitudinal axis;

a biasing member disposed in the opening and movable independently of the first member, and wherein the first member is movable linearly in a first direction that applies a load to the biasing member which creates a torque on the biasing member; and a second member that separates the first member and the biasing member such that the torque on the biasing member is transferred to the second member without transferring the torque to the first member when the first member applies the load to the biasing member to minimize rotation of the protrusion in the groove.

* * * * *